United States Patent [19]

Deaton

[11] Patent Number: 4,756,420

[45] Date of Patent: Jul. 12, 1988

[54] MULTI SIZE NESTING CONTAINERS WITH ANTI JAMMING

[75] Inventor: Thomas P. Deaton, Mason, Ohio

[73] Assignee: Buckhorn, Inc., Milford, Ohio

[21] Appl. No.: 27,896

[22] Filed: Mar. 19, 1987

[51] Int. Cl.[4] ..... B65D 21/02

[52] U.S. Cl. ..... 206/514; 206/518; 206/520

[58] Field of Search ..... 206/501, 505, 507, 514, 206/518, 519, 520

[56] References Cited

U.S. PATENT DOCUMENTS

| | | | |
|---|---|---|---|
| 2,994,457 | 8/1961 | Fornas . | |
| 3,326,408 | 6/1967 | Ringlen | 206/518 |
| 3,440,988 | 4/1969 | Bremer . | |
| 3,642,168 | 2/1972 | Wiley . | |
| 3,654,076 | 4/1972 | Hatch . | |
| 3,701,456 | 10/1972 | Alroy | 206/520 |
| 3,759,416 | 9/1973 | Constantine . | |
| 3,838,772 | 10/1974 | Lang | 206/520 |
| 3,965,616 | 6/1976 | Ridgeway | 206/520 |
| 4,127,189 | 11/1978 | Shumark | 206/520 |

FOREIGN PATENT DOCUMENTS

| | | | |
|---|---|---|---|
| 682760 | 3/1964 | Canada . | |
| 1063533 | 10/1979 | Canada | 206/518 |
| 1261651 | 2/1978 | Fed. Rep. of Germany | 206/520 |

*Primary Examiner*—George E. Lowrance

*Attorney, Agent, or Firm*—Fay, Sharpe, Beall, Fagan, Minnich & McKee

[57] ABSTRACT

A tote box system employs two sets of nesting boxes that are identical except for side wall height that provides different volumes and except for bottom configuration that prevents bottom damage when a tall container is nested within a short container. The bottom configuration is such that there are flat engaging horizontal surfaces supporting the tall box on the short box without substantial engagement between reinforcing channels or like slanted vertical portions of the bottom that would otherwise have a strong wedging action if they fully engaged, particularly with a large stack of nested boxes.

6 Claims, 3 Drawing Sheets

MULTI SIZE NESTING CONTAINERS WITH ANTI JAMMING

BACKGROUND OF THE INVENTION

For many years there has been widespread usage of integrally molded plastic boxes that are capable of nesting together when they are empty. Such boxes are usually provided with nesting stops that prevent full nesting, so that the boxes will not become jammed and therefore they may be easily separated.

SUMMARY OF THE INVENTION

At times, it is desirable to provide a family of boxes that are identical, except for a different capacity. For example, the boxes may be identical, except for differing in height. A large number of first boxes that are identical in one height would be capable of nesting within a large number of second boxes that are identical with each other and differ from the first box only in height. When the difference in size relates to height, the smaller box may easily nest within the taller box and the usual nesting stops of the shorter box will prevent jamming. With nesting of the tall box within the short box, the usual nesting stops will not engage.

When employing two series of nesting boxes that are identical except for their height to thereby provide two sizes, bottom damage can occur to an unusually large degree. Upon analysis, it has been determined that when identical boxes nest within each other, there is no problem. When a short box nests within a taller box, the usual nesting stops of the shorter box engage the top of the taller box and the bottoms are spaced far apart so that there is no problem. It has been determined that excessive bottom damage can occur from the nesting of a large box in a short box.

When nesting a tall box within a short box, which boxes are otherwise identical, the bottom portion of the taller box side wall is nesting within the top portion of the shorter box and therefore the sides are spaced from each other so that there is no side wall jamming even though the nesting stops do not engage. That is, side wall jamming is not a problem in such a case. Normally, the bottoms are configured with a three dimensional pattern so as to increase their strength.

It has been determined that with a conventional construction, the bottom of the taller top box has vertical wall portions that engage vertical wall portions of the lower short box in a strongly wedging manner due to the usual mold relief. When a large stack of empty boxes is being returned, for example in a large truck, where the stack may be eight feet high there is considerable weight on the bottom boxes. With this considerable weight and the wedging action of the bottom vertical wall portions, relatively great forces occur that can break or otherwise damage the box bottoms.

This wedging action that would occur with a conventional construction is prevented according to the present embodiment by constructing the bottoms of the short boxes differently from the bottoms of the larger boxes, so that the nesting top taller box will have horizontal bottom wall portions that will engage horizontal bottom wall portions of the shorter lower box before the vertical bottom wall portions engage, to thereby prevent the wedging action.

DETAILED DESCRIPTION OF A PREFERRED EMBODIMENT

The boxes of the present invention may take on any of a number of conventional constructions, except for the configuration of the bottoms, and the difference in height to provide two or more sets of boxes differing in volume. Therefore, the conventional details of box construction will be well known to those having ordinary skill in the tote box art and such details will not be specifically described.

Figure 1:
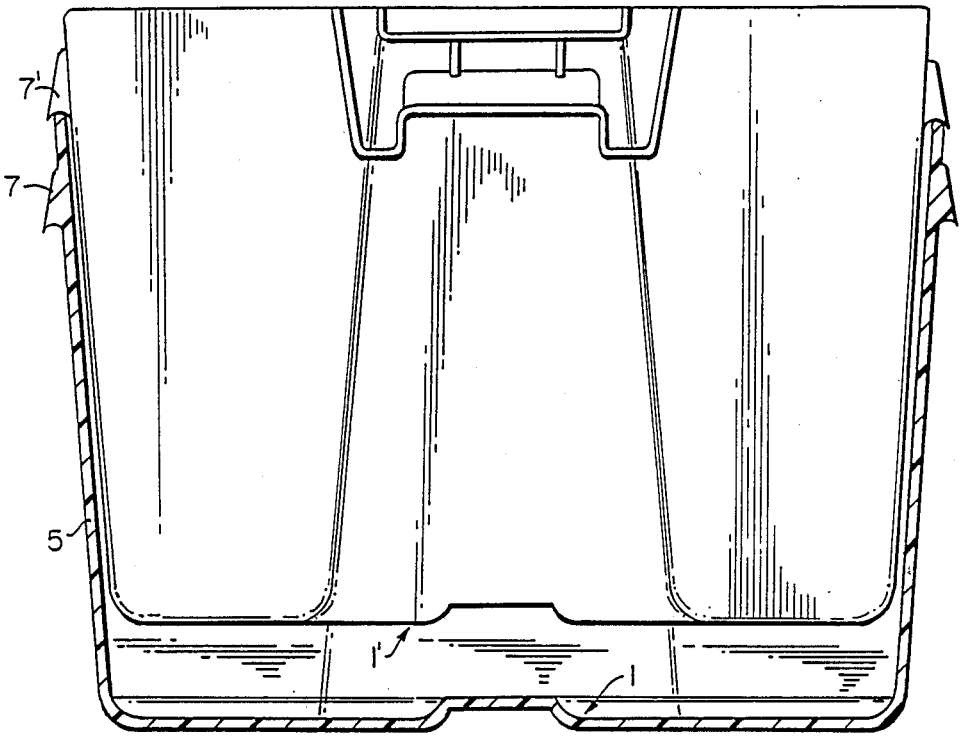
FIG. 1 is an end elevational view, partly in cross-section, of two identical large size boxes nesting.
Figure 2:
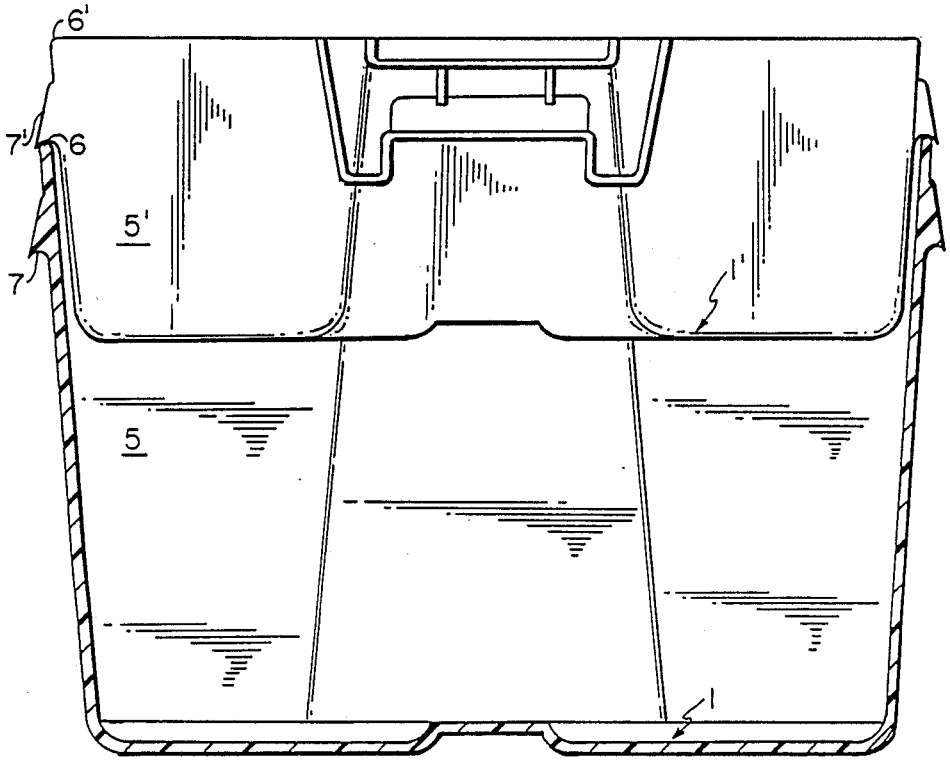
FIG. 2 is an end elevational view, partly in cross-section, of a short box nesting within a taller box.
Figure 3:
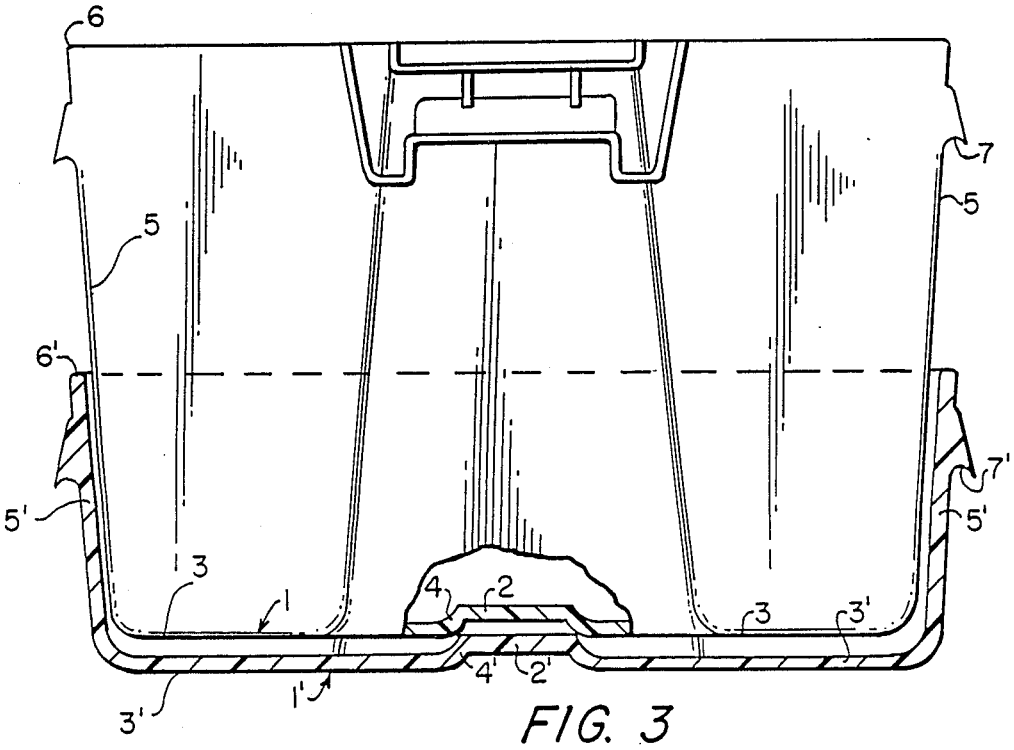
FIG. 3 is an end elevational view, partly in cross section, of a tall box nesting within a shorter box.

The boxes of the present invention are divided into a first set of identical tall boxes as shown in FIGS. 1 and 2 and on top with respect to the nested boxes in FIG. 3, and a second set of short boxes as shown from the bottom box in the nested pair of FIG. 3. More than two different size sets of boxes may be provided. Elements of the second box set that correspond to elements of the first box set will be described with respect to identical numerals and the addition of a prime.

Each box has a rectangular bottom wall 1, 1' of generally the same single sheet thickness and a three dimensional configuration as shown formed by first horizontal upper bottom portion 2, 2', second horizontal lower bottom portions 3, 3', and vertically extending web bottom portions 4, 4' interconnecting the horizontal bottom portions 3, 3' and 2, 2' to form downwardly opening reinforcing channels across the bottom. These boxes are unitarily molded of synthetic resin. The boxes within the first set are essentially identical and the boxes within the second set are essentially identical.

Each of the tote boxes has four generally rectangular side walls 5, 5', which may be conventional. In a conventional manner, the side walls are connected at bottom edges integrally with the bottom walls, 1, 1' and adjacent side edges with each other to upper edges 6, 6'. The side walls extend vertically upward and slope outwardly from the bottom wall at about the same slope so that like boxes may nest with each other as shown in FIGS. 3 and 2. Nesting stops 7, 7' are integrally formed with the respective side walls 5, 5'. The top edges 6, 6' engage with these nesting stops 7, 7' and may also be thought of as nesting stops. In a conventional manner, the nesting stops will engage an adjacent box, particular the upper edge 6, 6', for limiting full nesting of identical boxes as shown in FIG. 1. This will prevent side wall jamming because the nesting stops will positively engage and will space the bottom walls 1, 1' apart for nesting identical boxes as shown in FIG. 1. The second set of short boxes has side walls 5' that are of substantially less height than the side walls 5 of the first set of large boxes as shown in FIG. 3. The bottom walls of the boxes within the first set are substantially identical. The bottom walls of the boxes in the second set are substantially identical. Therefore, the two sets of boxes are of substantially different volumes with the first set being tall boxes and the second set being short boxes.

Each of the boxes within the second set of short boxes will nest within each other (not specifically shown in the drawing, but such nesting would be similar to that shown in FIG. 1), with interengagement of the short box nesting stops 6', 7' to space adjacent bottom walls 1' from each other.

Figure 6:
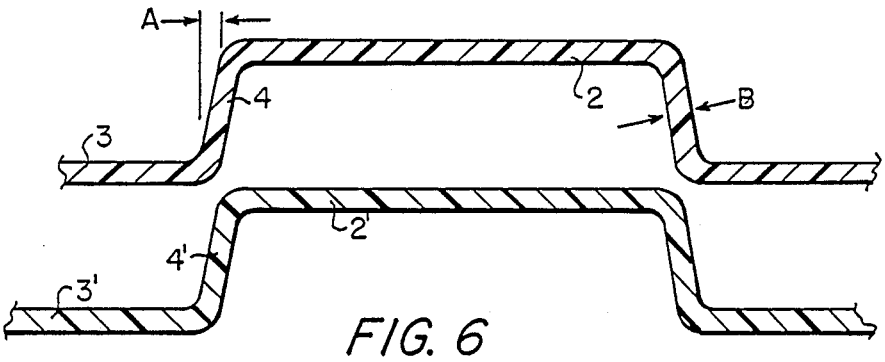
FIG. 6 is a partial cross-sectional view of a portion of the bottoms taken along line VI—VI in FIG. 5.

Each box within the first set of tall boxes are nestable within each box of the second set of short boxes with the nesting stops 7 and 6' spaced from each other and the bottom walls 1, 1' engaging so that the channels of the adjacent bottom walls are vertically aligned as shown in FIG. 3. As more specifically shown in FIG. 6, the channels do not engage with any material force. If the channels were to strongly engage, the channels would not nest but rather have a very strong wedging action between the vertically extending web bottom portions 4, 4' that would damage the bottoms, particularly for a high stack. However, as seen in FIG. 6, the channels do not wedgingly interengage. With the present embodiment, the channels are prevented from strongly interengaging when a large box is nested within a short box, because of the bottom wall surfaces 8, 8' that positively engage each other.

Figure 5:
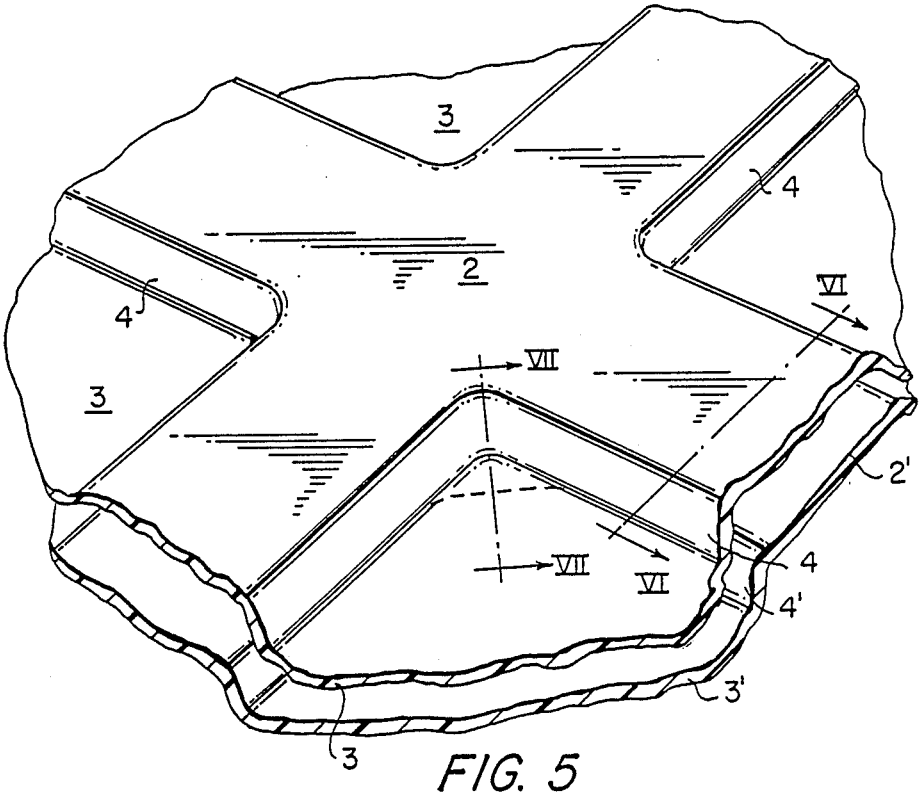
FIG. 5 is a partial perspective view, taken from the top, similar to the view of FIG. 4 with the tall box nesting within the shorter box.
Figure 4:
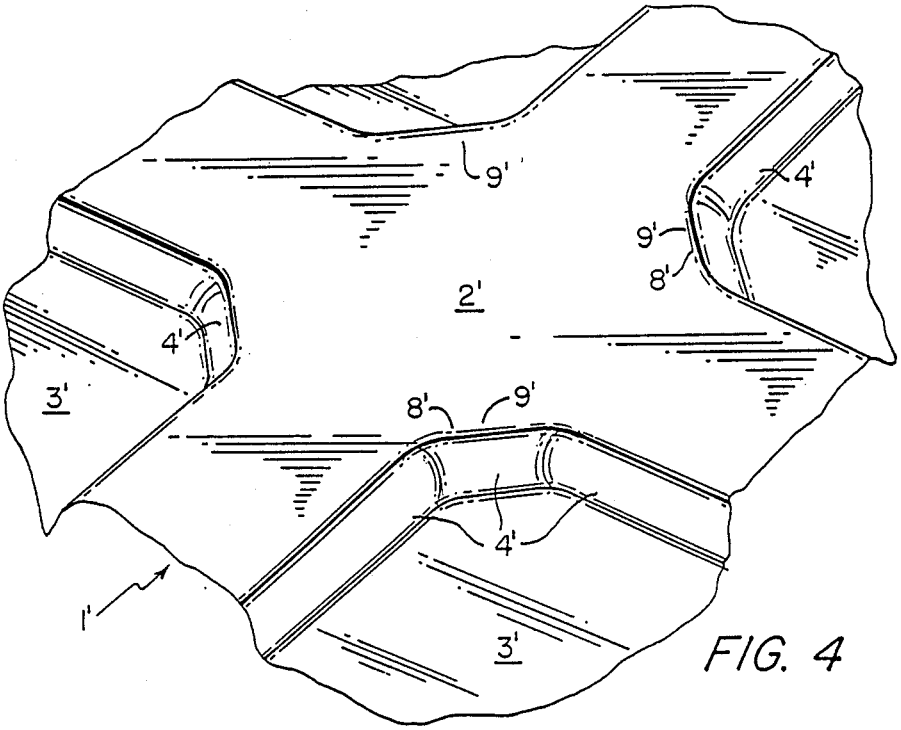
FIG. 4 is a partial perspective view, taken from the top, of a portion of the bottom wall of the short box.

For the preferred embodiment of the engaging surfaces 8, 8' there are a plurality of the channels for each bottom wall of the first set of tall boxes as shown for the top box in FIG. 5 and a corresponding plurality of the channels for each bottom wall of the second set of short boxes as shown in FIG. 4. The intersection of the channels form four corner portions for each such intersection, with the corner portions 9' of the shorter boxes being truncated to a greater extent than the corner portions 9 of the tall boxes. Preferably, the channels open downwardly so that the short box corner portions 9' are horizontal upper portions forming the corner surfaces 8' immediately below and engaging the corner surfaces 8 of the horizontal lower bottom portions of the upper box and the corners 9 during nesting of the tall box within the short box. Thus, the channels do not wedgingly interengage. Preferably, the corner surfaces 8, 8' formed by the corner portions 9, 9' are generally triangular shaped.

Figure 7:
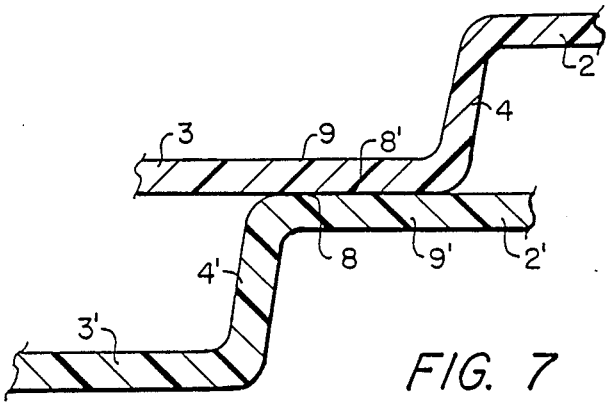
FIG. 7 is a partial cross-sectional view taken along line VII—VII in FIG. 5.

As seen from a comparison of FIG. 4 and FIG. 5, the horizontal upper bottom portions 2' of the second set of short boxes has a larger surface than horizontal upper portions 2 of the first set of tall boxes. The horizontal lower bottom portions 3' of the second set of short boxes has a smaller surface than the horizontal lower bottom portions 3 of the first set of tall boxes, with the difference in size of the surfaces being constituted by the aligned horizontal surface portions 8, 8' that supportingly engage each other when a tall box is nested within a short box as shown in FIG. 7.

As seen in the enlargement of FIG. 6, the vertically extending bottom wall portions 4 slope, preferably in a conventional manner to provide for the usual mold relief. As a result, the inside corner portion at the juncture of wall portions 3 and 4 for the upper box align with the upper outside corner portion for the junction between the bottom wall portions 4' 2', because the vertically extending bottom wall portions 4, 4' are vertically aligned. Therefore, considerable wedging action can occur without the present invention. In general, the bottoms are constructed of a single thickness B. Of course, the thickness may be conventionally increased at various points to provide for ribbing and the like.

It is thus seen that a very simple change in the bottom construction of two sets of tall and short boxes can provide safe nesting of the tall box within a short box without destructive wedging interengagement of reinforcing bottom channels.

Further objects, features and advantages together with modifications and further embodiments are all contemplated according to the spirit and scope of the present invention, as fully defined by the following claims.

What is claimed is:

1. A tote box system, comprising:

first and second sets of respectively identical unitary molded synthetic resin tote boxes each box having a rectangular bottom wall of generally the same single sheet thickness and a three dimensional configuration formed by first horizontal upper bottom portions, second horizontal lower bottom portions, and vertically extending web bottom portions interconnecting said horizontal bottom portions to form reinforcing channels across the bottom;

each of said tote boxes further having four generally rectangular side walls connected at bottom edges integrally with said bottom wall and at adjacent side edges with each other to leave upper edges, said side walls extending vertically upwardly and sloping outwardly from said bottom wall at about the same slope so that like boxes may nest within each other;

nesting stops integrally formed with said side walls of said boxes for limiting full nesting of identical boxes within each other to prevent side wall jamming upon nesting, said nesting stops positively engaging to space the bottom walls of nesting identical boxes from each other;

said second set of boxes having side walls that are of substantially less height than the side walls of said first set and bottom walls of substantially identical rectangular shape as said first set so that the two sets of boxes are of substantially different volumes with the first set being tall boxes and the second set being short boxes;

each of said second set of short boxes being nestable within each of said first set of tall boxes with interengaging of said nesting stops to space adjacent bottom walls from each other;

each of said first set of tall boxes being nestable within each of said second set of short boxes with their nesting stops spaced from each other and their bottom walls engaging so that the channels of the adjacent bottom walls are vertically aligned;

each of said second set of short boxes having a plurality of said channels for each of said bottom walls of both sets, with said plurality of channels intersecting each other to provide corner portions having corner surfaces, and the corner portions of the short boxes being truncated to a greater extent than the corner portions of said tall boxes; and said channels opening downwardly so that said short box corner surfaces extend outwardly from said channels in comparison to said tall box corner surfaces so that said corner surfaces of the horizontal lower bottom portions of the upper tall box set on said short box corner surfaces during nesting of the tall box within the short box prior to interengagement of said channels for preventing channel wedging interengagement and consequent damage.

2. The system of claim 1, wherein said corner surfaces have a generally triangular shape.

3. The system of claim 1, wherein said plurality of intersecting channels provide a plurality of intersections, each intersection having four said corner surface portions that are of generally triangular shape.

4. The system of claim 1, wherein the horizontal upper bottom portions of said second set of short boxes has a larger surface area than the horizontal upper bottom portions of said first set of tall boxes, and the horizontal lower bottom portions of said second set of short boxes has a smaller surface area than the horizontal lower bottom portions of said first set of tall boxes, to provide a plurality of said corner surfaces that are vertically aligned such that said corner surfaces of said second set of short boxes supportingly engage a corresponding plurality of corner surfaces of said first set of tall boxes.

5. In a tote box system, wherein the tote boxes are constructed with a bottom wall and upwardly and outwardly sloping side walls so that they may be nested together when empty and are provided with side wall nesting stops to prevent side wall jamming when nested, the improvement comprising:

said boxes being in at least two sets differing substantially only in side wall height and bottom configuration to provide one set of identical tall boxes and a second set of identical short boxes, so that the nesting stops engage to prevent nesting jamming when boxes within a set are nested with each other and when a short box is nested within a tall box;

the bottom wall of each box having a three dimensional configuration including coplanar horizontal uppermost bottom portions, coplanar downwardmost bottom portions and sloping vertically extending webs extending between said uppermost and downwardmost bottom portions to form downwardly opening channels to provide rigidity for the bottom wall;

said webs of each of said sets of boxes being substantially vertically aligned respectively for a tall box nesting within a short box except for said short box having vertically misaligned web portions; said misaligned web portions of said short box being offset outwardly with respect to vertically adjacent webs of the nested tall box such that a section of said short box channel including said misaligned web portions is enlarged to provide an increased surface area of the uppermost bottom portion of the short box as compared with the tall box; and said increased surface area forming a horizontal planar support surface extending between said misaligned web portions and said vertically adjacent webs of the nested tall box that is coplanar with said uppermost bottom wall portions, and said support surface being the sole support for the bottom wall of the adjacent nested tall box for engaging the downwardmost bottom portion of the tall box during nesting to limit substantial interengagement between said channels for preventing destructive wedging engagement between said webs.

6. The system of claim 5, wherein each of said boxes have a plurality of said channels intersecting each other to form intersections, said channels of each of said boxes having a first width dimension extending across said uppermost bottom portion, and said misaligned web portions of said short box tapering outwardly from said channels adjacent said intersections such that said width dimension of said channels is increased adjacent said intersections in comparison with said first width dimension to provide said support surface.

* * * * *